US007712677B1

(12) United States Patent
Munsterhuis et al.

(10) Patent No.: US 7,712,677 B1
(45) Date of Patent: May 11, 2010

(54) WATER HEATER AND CONTROL

(75) Inventors: Sybrandus B. V. Munsterhuis, GP Dalen (NL); Brent Chian, Plymouth, MN (US); Timothy J. Nordberg, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 1620 days.

(21) Appl. No.: 10/911,151

(22) Filed: Aug. 3, 2004

Related U.S. Application Data

(63) Continuation-in-part of application No. 10/382,056, filed on Mar. 5, 2003, now Pat. No. 6,955,301.

(51) Int. Cl.

| | |
|---|---|
| ***G05D 15/00*** | (2006.01) |
| ***G05D 23/00*** | (2006.01) |
| ***H05B 1/02*** | (2006.01) |
| ***F24H 9/20*** | (2006.01) |
| ***F24H 1/18*** | (2006.01) |

(52) U.S. Cl. ..... 236/20 R; 219/494; 122/14.22; 392/449; 392/498

(58) Field of Classification Search ..... 236/20 R, 236/78 B, 91; 122/14.22; 219/510, 494; 392/498, 449; 700/299, 300
See application file for complete search history.

(56) References Cited

U.S. PATENT DOCUMENTS

| | | | | |
|---|---|---|---|---|
| 4,333,002 | A | 6/1982 | Kozak | |
| 4,508,261 | A | 4/1985 | Blank | 236/20 R |
| 4,511,790 | A | 4/1985 | Kozak | |
| 4,588,875 | A | 5/1986 | Kozak et al. | |
| 4,696,639 | A | 9/1987 | Bohan, Jr. | 431/59 |
| 4,734,658 | A | 3/1988 | Bohan, Jr. | 331/117 |
| 4,770,629 | A | 9/1988 | Bohan, Jr. | 431/59 |
| 4,834,284 | A * | 5/1989 | Vandermeyden | 236/20 R |
| 4,984,981 | A | 1/1991 | Pottebaum | 431/80 |
| 4,986,468 | A | 1/1991 | Deisinger | |
| 5,056,712 | A | 10/1991 | Enck | |
| 5,495,551 | A * | 2/1996 | Robinson et al. | 392/451 |
| 5,660,328 | A * | 8/1997 | Momber | 236/20 R |
| 5,797,358 | A | 8/1998 | Brandt et al. | 122/448.1 |
| 5,968,393 | A * | 10/1999 | Demaline | 219/492 |

(Continued)

FOREIGN PATENT DOCUMENTS

| | | | |
|---|---|---|---|
| GB | 2211331 | A | 6/1989 |

OTHER PUBLICATIONS

U.S. Appl. No. 10/382,056, filed Mar. 5, 2005, Munsterhuis et al.

(Continued)

*Primary Examiner*—Chen-Wen Jiang
(74) *Attorney, Agent, or Firm*—McDonnell Boehnen Hulbert & Berghoff LLP

(57) ABSTRACT

An improved heater and method of controlling the same is provided. The water heater has the combination of a tank for holding water, a heater for heating the water, a controller having logic to regulate the heater, and first and second sensors. Each of the sensors detects the water temperature at different areas within the water heater. The sensors also provide the controller with signals corresponding to the detected water temperature. In response to these signals, the controller regulates the heater when at least one of the signals of the first and second sensors satisfies at least one predetermined state condition.

25 Claims, 10 Drawing Sheets

U.S. PATENT DOCUMENTS

| | | | | |
|---|---|---|---|---|
| 6,059,195 | A | 5/2000 | Adams | |
| 6,178,291 | B1 * | 1/2001 | Zenios et al. | 392/479 |
| 6,261,087 | B1 | 7/2001 | Bird et al. | 431/50 |
| 6,293,471 | B1 | 9/2001 | Stettin et al. | 236/20 R |
| 6,350,967 | B1 | 2/2002 | Scott | |
| 6,363,218 | B1 * | 3/2002 | Lowenstein et al. | 392/498 |
| RE37,745 | E | 6/2002 | Brandt et al. | 122/14.2 |
| 6,560,409 | B2 * | 5/2003 | Troost, IV | 392/498 |
| 6,959,876 | B2 | 11/2005 | Chian et al. | |
| 7,221,862 | B1 | 5/2007 | Miller et al. | |
| 2001/0009609 | A1 * | 7/2001 | Bradenbaugh | 392/463 |
| 2001/0020615 | A1 * | 9/2001 | Bradenbaugh | 219/497 |
| 2001/0031138 | A1 | 10/2001 | Troost, IV | 392/498 |
| 2002/0132202 | A1 * | 9/2002 | Clifford | 431/264 |
| 2004/0069768 | A1 * | 4/2004 | Patterson et al. | 219/492 |
| 2007/0175883 | A1 | 8/2007 | Miu et al. | |

OTHER PUBLICATIONS

Office Action mailed Jul. 26, 2006.
Office Action mailed Jan. 10, 2007.
Office Action mailed Sep. 10, 2007.
Office Action mailed Mar. 21, 2008.
Office Action mailed Oct. 6, 2008.

* cited by examiner

WATER HEATER AND CONTROL

RELATED APPLICATIONS

The present application is a continuation-in-part of U.S. patent application Ser. No. 10/382,056, filed Mar. 5, 2003, for "Water Heater and Control," which is assigned to the same assignee as the present application.

The present application is related to U.S. patent application Ser. No. 09/745,686, filed Jan. 3, 2000, entitled "Hot Water Heater Stacking Reduction Control," which is assigned to the same assignee as the present application, and which is fully incorporated herein by reference. Further, the present application is related to concurrently filed, and commonly assigned, U.S. Patent Applications entitled "Method and Apparatus for Safety Switch" Ser. No. 10/424,257, "Method and Apparatus for Thermal Power Control" Ser. No. 10/382,050, and "Method and Apparatus for Power Management" Ser. No. 10/382,303, all of which are fully incorporated herein by reference.

BACKGROUND

1. Field of the Invention

The present invention relates to water heaters and more particularly to a water heater with an improved water-heater-controller assembly and an improved water-heater-control method.

2. Description of Related Art

Water heaters are used in homes, businesses and just about any establishment having the need to heat water. Water heaters heat water using the simple "heat rises" principle. In operation, water heaters heat cold or ambient temperature water entering at or near the bottom of the water heater to a desired temperature using a gas-fired burner, an electric heater or some other form of energy. During a heating cycle, the cold or ambient temperature water at the bottom of the water heater becomes hotter and begins to rise towards the top of the water heater. Denser water, once on top of the water being heated, falls toward the bottom of the water heater so that it can be heated to the desired temperature. After the temperature of the water at the bottom of the water heater reaches a certain desired temperature, the water heater stops heating the water.

When demand for hot water arises (e.g., someone turns on a faucet to run a shower), fresh, cold or ambient water enters the water heater and "pushes out" or supplies the hotter water at or near the top of the water heater. When a sufficient amount of the hotter water exits from the top of the water heater so that the fresh, cold or ambient water entering the bottom causes the temperature of the water at the bottom of the tank to drop below the desired temperature, the water heater repeats the heat cycling.

A conventional water heater typically has at least one heating element or "heater," such as a gas-fired and/or electric burner. To take advantage of the "heat-rises" principle, the heater is located at or near the bottom of the water heater. Each water heater typically also has at least one thermostat or controller for controlling the heater.

To facilitate the heating of water, the controller receives signals related to the temperature of the water. When these signals indicate that the water temperature is below a predetermined threshold, for example, when the water temperature is below 120 degrees Fahrenheit, the controller turns on the heater and the water at or near the bottom of the water heater begins to heat. After some time, the temperature of the water at the bottom of the water heater increases to a second threshold, which, for example, may be about 140 degrees Fahrenheit. When receiving signals indicating that the water temperature at the bottom of the tank is greater than the second threshold, the controller causes the heater to reduce its heat output or, alternatively, causes the heater to turn off. The heat cycle begins again when the temperature of the water at the bottom of the water heater drops below the first threshold.

Unfortunately, the signals received by the controller only indicate the temperature of the water close to or at the water heater's bottom. Consequently, the water at the top of the water heater, i.e., the water supplied upon demand, may be at a different temperature from the water at the bottom. The water at the top is typically hotter than or close to the same temperature as the water at the water heater's bottom. Further, depending on demand for water, heat cycling, and heat loss, water temperature throughout the water heater might not equalize. Generally, in operation, the temperature of the water in the water heater does not equalize, but rather has one or more temperature gradients. That is, there may be hot and cold "spots" within the water heater, which can cause problems with outgoing temperature of the water. In some cases, these gradients may become substantial.

In one situation, when the demand for hot water from the water heaters is rapidly cycled on and off, the controller may follow in sequence. Cycling the controller on and off in turn cycles the heater on and off. Consequently, the water within the water heater may become layered by temperature. This phenomenon is known as temperature stacking or stratification. Because of temperature stratification, the temperature of the water at the top of the water heater during this multiple cycling might be within or close to the first and the second threshold. Thus, upon demand, delivered water may be hot or cold. In this situation, as well as others, the water heater may be energy inefficient, since the heater will needlessly cycle on when the water temperature at the top of the water heater is within an acceptable range.

Thus, it is desirable to provide a method and system to better control the delivered water temperature, and to control the temperature of the water in an energy-efficient manner.

SUMMARY

A water heater having the combination of a tank for holding water, a heater for heating the water, a controller having logic to regulate the heater, and first and second sensors. Each of the sensors detects the water temperature at different areas within the water heater. The sensors also provide the controller with signals corresponding to the detected water temperature. In response to these signals, the controller regulates the heater when at least one of the signals of the first and second sensors satisfies at least one predetermined state condition.

BRIEF DESCRIPTION OF THE DRAWINGS

Exemplary embodiments of the invention are described below in conjunction with the appended figures, wherein like reference numerals refer to like elements in the various figures, and wherein.

DETAILED DESCRIPTION OF EXEMPLARY EMBODIMENTS

1. Exemplary Architecture

Figure 1:
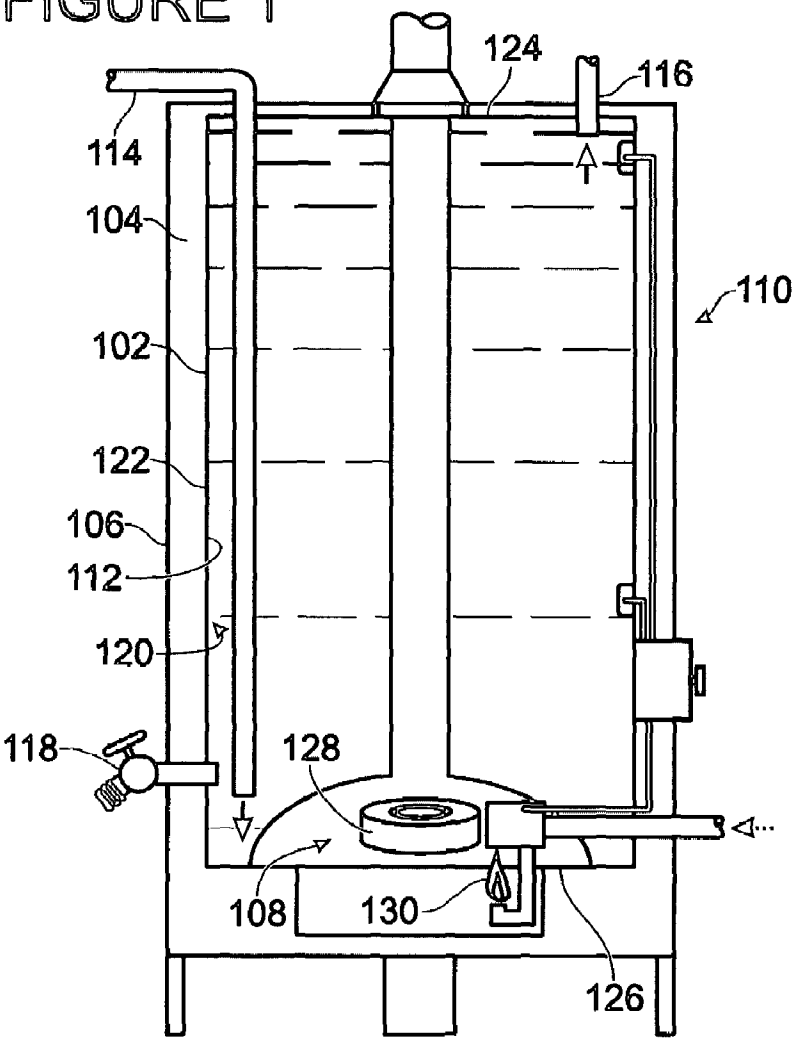
FIG. 1 is cutaway view of a water heater according to an exemplary embodiment.

FIG. 1 is cutaway view of a water heater 100 of an exemplary embodiment. The water heater 100 includes a tank 102, an insulating layer 104, an external shell 106, a heater 108, and a controller assembly 110. The tank 102 holds water that is to be heated and may be constructed of steel or other heat conducting material. The tank 102 has an inner surface 112, an input supply tube or dip tube 114, an output conduit or pipe 116, a drainage valve 118, a rust inhibiting liner 120, and an outer surface 122.

The insulating layer 104 may be located between the outer surface 122 of the tank and the external shell 106. The insulating layer 104 limits or otherwise minimizes the heat loss of the heated water from passing from the tank 102 to the outside world. Bonded to the inside of the inner surface 112 is the rust inhibiting liner 120. In addition, the tank 102 may have a sacrificial anode rod to keep the tank 102 from corroding.

The tank 102 also has a top surface 124 and bottom surface 126. Passing through the top surface 124 are the dip tube 114 and the output pipe 116. The output pipe 116 extends through the top surface 124 to a second predetermined distance from the bottom surface 126. This second predetermined distance may be fairly close to the top surface 124. Having the output pipe 116 close to the top surface 124 allows the hotter water, which may be the hottest water in the tank 102, to exit the tanks upon demand. In operation, when the hot water is demanded, fresh water flows into the dip tube 114 to the bottom of the tank 102 and pushes or otherwise causes the hotter water at the top of the tank 102 to exit through the output pipe 116.

Like the output pipe 116, the dip tube 114 extends through the top surface 124 to a predetermined distance from the bottom surface 126. This predetermined distance may be fairly close to the bottom surface 126. Having the exit of the dip tube 114 close to the bottom surface allows the fresh, cold or ambient water to enter the tank near the bottom surface 126. This prevents the cold or ambient water from mixing and cooling the hotter water near the top surface 124. In practice, the dip tube 114 may be typically located about three quarters of the distance from the top surface 124 to the bottom surface 126. Because the fresh water entering the tank 102 is denser than heated water, the fresh water sinks to the bottom of the tank 102, where it may be heated.

The heater 108 heats the tank 102, which in turn heats any water inside the tank 102. The heater 108 may be a gas-fired heater, an electric heater, a plurality of gas-fired burners, a plurality of electric heaters, a combination of gas-fired and electric heaters or any other heat source. When called upon, the heater 108 may provide a small amount of heat, a large amount of heat, or no heat at all.

In the exemplary gas-fired water heater shown in FIG. 1, heater 108 may have a gas-flow valve (not shown), a burner 128 and an ignition source 130. The gas-flow valve may be a solenoid-controlled valve, a linear actuated valve, a motor actuated valve, or any other valve capable of supplying gas to the burner 128. The ignition source 130 may be a pilot light, a solid-state igniter, an electric heat element, or any other ignition source capable of igniting gas.

The heat output of the heater 108 may be controlled by burner orifice size, gas pressure, and/or time. To produce heat in the gas-fired water heater, gas flows into the burner 128 through the gas-flow valve, where the ignition source 130 ignites the gas. The gas will continue to burn until the supply of gas is terminated.

In an alternative water heater embodiment (not shown), the heat output may be controlled by an electric current flow through an electric heating element. To produce heat in an electric heater, the amount of current impressed on the electric heating element is regulated. In regulating the heat output, the more current impressed on the electric heating element, the more heat is produced. Conversely, less or no heat is produced if the current is reduced or turned off, respectively.

Figure 2:
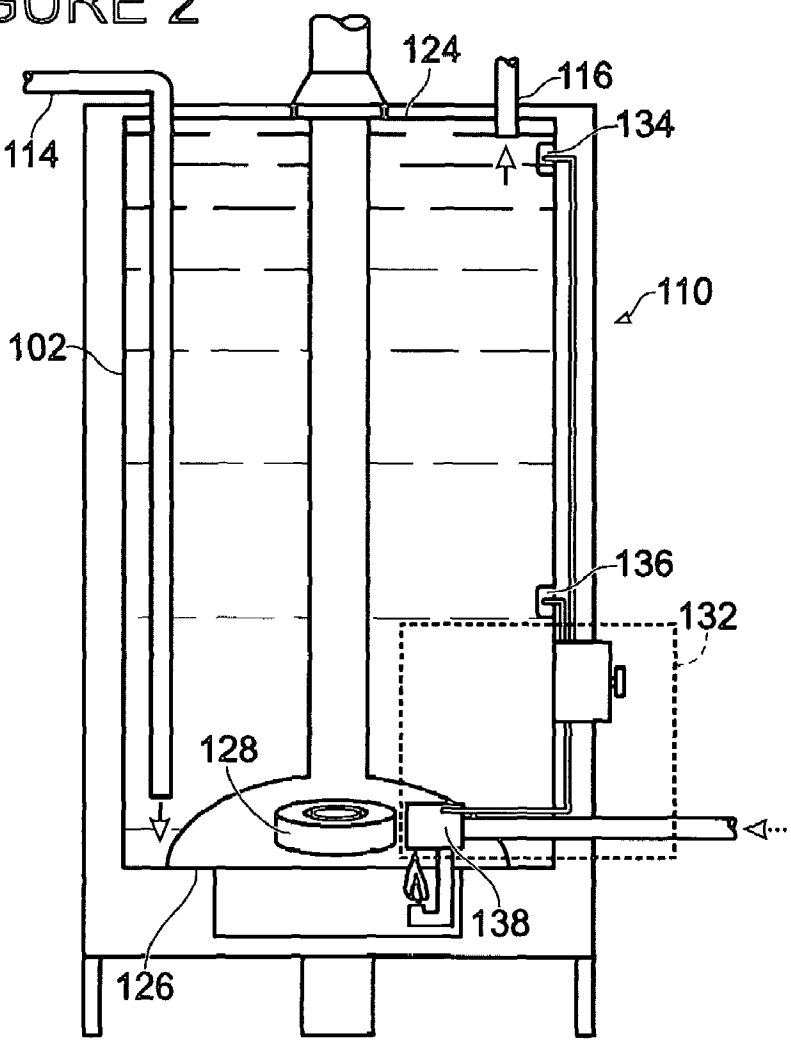
FIG. 2 is a second cutaway view of a water heater according to an exemplary embodiment.

FIG. 2 illustrates a water heater 100 with a controller assembly 110. For simplicity, hereinafter the controller assembly 110 is described in reference to an exemplary gas-fired water heater. Those skilled in the art will recognize that the controller assembly 110 is not limited to such an embodiment, and other controller assemblies, such as those used with electric water heaters, are possible as well.

The controller assembly 110 includes a logic unit 132, a first sensor 134, a second sensor 136, and a gas-flow-valve actuator 138. The logic unit 132 may include a set of relay logic modules, a processor, and programmable instructions for producing an output to actuate the gas-flow valve actuator 138. As those skilled in the art will recognize, the logic unit 132 may have other alternative constructions as well. Details of an exemplary logic unit and controller are provided by another U.S. patent application filed concurrently with this document, and entitled "Method and Apparatus for Safety Switch" Ser. No. 10/424,257.

The logic unit 132 receives signals from the first and second sensors 134, 136. Based on those signals, the logic unit 132 may produce an output to initiate a heat cycle. During the heat cycle, the logic unit 132 actuates the gas-flow-valve actuator 138, which in turn opens the gas-flow valve to supply gas to burner 128. When gas is supplied to the burner 128, the logic unit 132 triggers the ignition source 130 to ignite the gas, if the ignition source 130 requires such trigger.

The burner 128 then burns the gas until the demand for heat ceases. Once the heat demand ceases, the logic unit 132 may produce a second output. This second output, in turn, deactivates the gas-flow-actuator 138, thereby shutting off the gas supply and dampening the firing of the burner 128.

The first sensor 134 may be a temperature sensor or another device capable of sensing water temperature at or near the top of the tank 102. Thus, for example, a sensor capable of detecting a property of the water from which the water temperature may be derived (such as pressure) may also be used with the present system. While in an exemplary embodiment the first sensor 134 may be located towards the top surface 124 near the exit opening in the output pipe 116, the sensor need not be physically located at the top of the water heater, provided that the temperature of the water at or near the top is detected by the sensor. In practice, the top sensor may be located from about 4 to about 8 inches from the top surface 124.

The first sensor 134 may provide to the logic unit 132 signals related to the detected water temperature. Alternatively, first sensor 134 may also incorporate switches and logic modules so as to provide the logic unit 132 with switched signals that relate to the detected water temperature. For instance, in response to the first sensor 134 detecting a hot water temperature that is over a given threshold, one or more of such logic modules may cause one of the switches to open or close, thereby signaling the logic unit 132 that the hot water temperature is over the given threshold. Further, the logic modules may keep the switch in that position so long as the detected temperature is over the given threshold.

Like the first sensor 134, the second sensor 136 may be a temperature sensor, or another device capable of sensing water temperature at or near the bottom of the tank 102. In an exemplary embodiment, the second sensor 136 may be located towards the bottom surface 126 and towards the exit of the dip tube 114. The second sensor 136, however, need not be located in such position; rather all that is required is that the second sensor 136 may sense the water temperature at or near the bottom of the tank. Again, like the first sensor 134, the second sensor 136 may provide to the logic unit 132 signals related to the detected water temperature. Alternatively, the second sensor 136 may also incorporate switches and logic modules so as to provide the logic unit 132 switched signals related to the detected water temperature.

The gas-flow-valve actuator 138 controls the amount of heat delivered by the heater 108. In the exemplary embodiment shown in FIG. 1, the gas-flow-valve actuator 138 controls the opening and closing of the gas-flow valve. When heat is called for, the gas-flow-valve actuator 138 opens the gas-flow valve, which allows gas to flow into the burner 128. When the logic unit 132 sends the gas-flow-valve actuator 138 an indication to stop the gas flow, it closes the gas-flow valve, thereby causing cessation of gas and, in turn, heat.

2. State Conditions for Water Heater Control

Figure 3A:
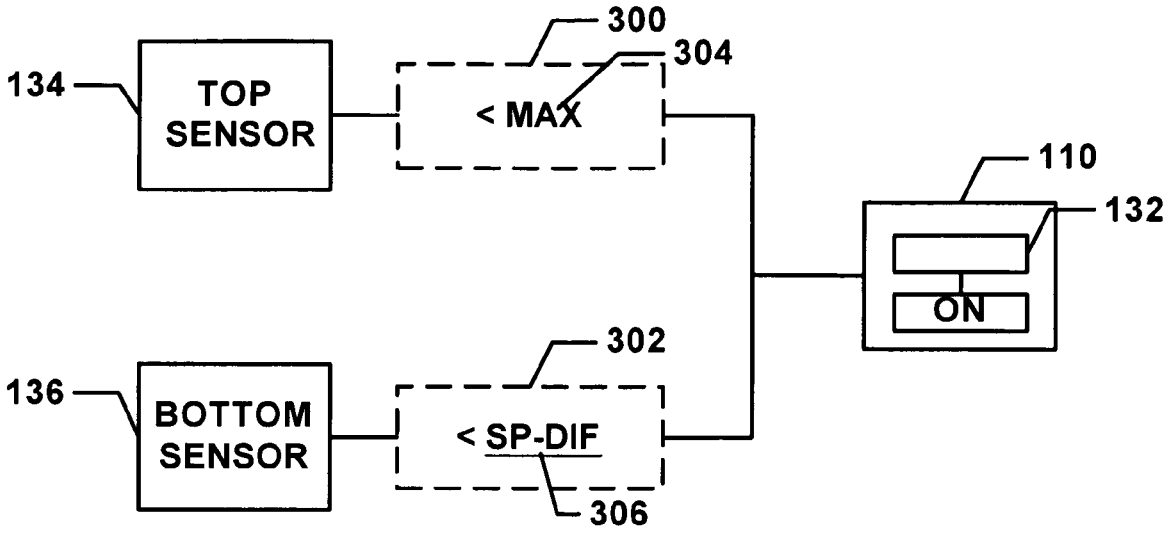
FIG. 3A is a state diagram illustrating a first of the processing states for the controller shown in FIG. 2 according to an exemplary embodiment.

FIGS. 3A-3D are a series of state diagrams showing operation of the controller in FIG. 2. Referring to FIG. 3A, the logic unit 132 may initiate a heat cycle when at least two conditions are met, namely state 300 and state 302. If the same conditions exist, but the heat cycle has already begun, the logic unit 132 maintains the heat cycle. Thus, when both state 300 and 302 are met, the logic unit 132 may send an indication to the gas-flow-valve actuator 138 to turn on or, at least, not to turn off.

The first of these two conditions or state 300 occurs when the first sensor 134 detects, measures, or otherwise determines that the water temperature at or near the top of the tank 102 is less than a maximum-temperature threshold 304. "Less than" includes "less than and equal to" as well.

This maximum-temperature threshold 304 may be user selectable, fixed at a given temperature, and/or varied. The maximum-temperature threshold 304 may be chosen to control temperature stacking. Thus, the maximum-temperature threshold 304 may be a temperature just below a point where unacceptable temperature stacking occurs.

Alternatively, the maximum-temperature threshold 304 may be a first "cut-off" temperature threshold. The first cut-off temperature threshold may be a desired-setpoint temperature of the water exiting the pipe plus or minus a first differential temperature. The actual temperature of the water exiting the output pipe 116, however, may be less than or greater than the first cut-off temperature.

The first differential temperature may be several degrees above or below the desired setpoint temperature. In practice, this first differential temperature assists in providing heat-hysteresis control and limits cycling the heater when the water temperature oscillates around the desired-setpoint temperature.

In another alternative embodiment, the maximum-temperature threshold 304 may be just below an overheat temperature threshold. This overheat temperature threshold may be the temperature at which the first and/or second sensors 134, 136 indicate to the logic unit 132 that the water heater may be malfunctioning. In response such indication by either sensor, the logic unit 132 or some other fail-safe circuitry may prevent the water heater from further operation until being serviced and/or reset.

The maximum-temperature threshold 304, however, is not limited to these exemplary embodiments, but may be another temperature as well. For example, the maximum-temperature threshold 304 may be varied as a function of a temperature detected by the second sensor 136.

The second of the two conditions or state 302 occurs when the second sensor 136 detects, measures, or otherwise determines that the water temperature at or near the bottom of the tank 102 is less than a first-setpoint-temperature threshold 306. Hereinafter, "less than" includes "less than and equal to," and "greater than" includes "greater than and equal to."

This first-setpoint-temperature threshold 306 may be user selectable, fixed, and/or varied. In an exemplary embodiment, the first-setpoint-temperature threshold 306 may be chosen to limit the cycle rate. In another exemplary embodiment, the first-setpoint-temperature threshold 306 may be a first "turn-on" temperature threshold. This threshold may be the desired-setpoint temperature of the water exiting the pipe plus or minus a second-differential temperature. The actual temperature of the water exiting the output pipe 116, however, may be less than or greater than the turn-on temperature threshold.

The second differential temperature may be several degrees above or below the desired setpoint temperature. In practice, this second differential temperature provides heat-hysteresis control and limits cycling the heater when the water temperature oscillates around the desired setpoint temperature.

The first-setpoint-temperature threshold 306, however, is not limited to these exemplary embodiments, but may be another temperature as well. For instance, the first-setpoint-temperature threshold 306 may be varied as a function of a temperature detected by the first sensor 134.

Figure 3B:
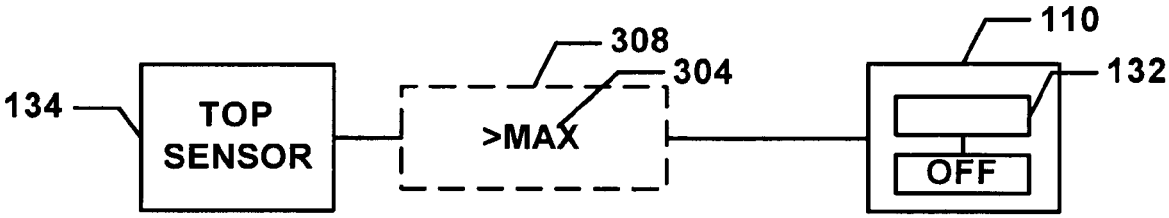
FIG. 3B is a second state diagram illustrating a second of the operational states for the controller shown in FIG. 2 according to an exemplary embodiment.

Referring now to FIG. 3B, the logic unit 132 may terminate a heat cycle or prevent a heat cycle from occurring when at least one condition is met, namely state 308. The state 308 occurs when the first sensor 134 detects, measures, or otherwise determines that the water temperature at or near the top of the tank 102 is greater than the maximum-temperature threshold 304. When state 308 is met, the logic unit 132 may send an indication to the gas-flow-valve actuator 138 to turn off or, at least, not to turn on.

Figure 3C:
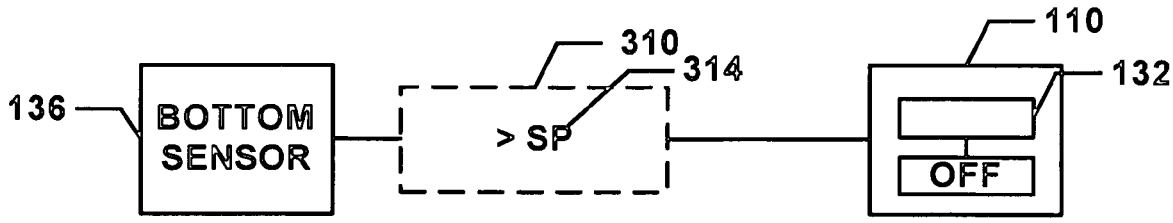
FIG. 3C is a third state diagram illustrating a third of the operational states for the controller shown in FIG. 2 according to an exemplary embodiment.

Referring now to FIG. 3C, the logic unit 132 may terminate a heat cycle or prevent a heat cycle from occurring when state 310 is met. The state 310 occurs when the second sensor 136 detects, measures, or otherwise determines that the water temperature at or near the bottom of the tank 102 is greater than a second-setpoint-temperature threshold 314. Thus, when state 310 is met, the logic unit 132 may send an indication to the gas-flow-valve actuator 138 to turn on or, at least, not to turn off.

This second-setpoint-temperature threshold 314 may be user selectable, fixed, and/or varied. In an exemplary embodiment, the second-setpoint-temperature threshold 314 may be a second cut-off temperature threshold. This second cut-off temperature threshold may be the desired-setpoint temperature of the water exiting the output pipe 116. The actual temperature of the water exiting the output pipe 116, however, may be less than or greater than the second cut-off temperature.

The second-setpoint-temperature threshold 314, however, is not limited to these exemplary embodiments, but may be another temperature as well. Similar to the other thresholds, the second-setpoint-temperature threshold 314 may be varied as a function of a temperature detected by the first sensor 134.

Figure 3D:
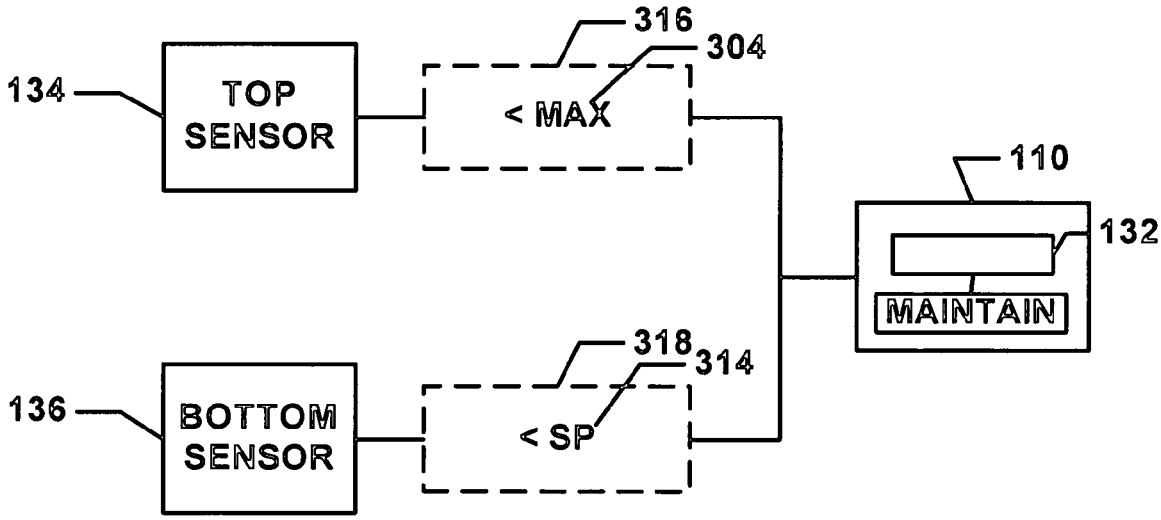
FIG. 3D is a fourth state diagram illustrating a fourth of the operational states for the controller shown in FIG. 2 according to an exemplary embodiment.

Referring now to FIG. 3D, the logic unit 132 may maintain an ongoing heat cycle when at least two conditions are met, namely states 316 and 318. Thus, when states 316 and 318 are met, the logic unit 132 may send an indication to the gas-flow-valve actuator 138 to maintain its current operation.

The state 316 occurs when the first sensor 134 detects, measures, or otherwise determines that the water temperature at or near the top of the tank 102 is less than the maximum-temperature threshold 304. The state 318 occurs when the second sensor 136 detects, measures, or otherwise determines that the water temperature at or near the bottom of the tank 102 is less than the second-setpoint-temperature threshold 314.

The following illustrates an exemplary operation of the water heater for the states illustrated in FIGS. 3A-3D. For this example, assume that the water heater is full of water. Further, assume that the water heater has recently finished a heat cycle so that the water temperature detected by the second sensor 136 is close to the desired-setpoint temperature. In this example, the desired-setpoint temperature is approximately 135 degrees Fahrenheit.

Further, assume that the water temperature at the top of the tank 102 as detected by the first sensor is initially less than the maximum-temperature threshold 304. The maximum-temperature threshold 304 may be approximately 142-degrees Fahrenheit (approximately 7 degrees Fahrenheit above the desired setpoint temperature).

As another initial condition, the maximum-temperature threshold 304 may be below the overheat temperature threshold. The overheat temperature threshold, for instance, may be approximately 5 degrees above the maximum-temperature threshold 304. In this example, the overheat temperature may be approximately 147 degrees Fahrenheit. The overheat temperature threshold may be other temperatures as well.

When a demand for hot water occurs, fresh, cold or ambient temperature water flows into the tank 102 through dip tube 114 and exits at or near the bottom of the tank 102. The second sensor 136 detects the inrush of cold or ambient water at or near the bottom of the tank 102. As the cold or ambient water enters, the hotter water at the top of the tank exits through an inlet in the output pipe 116.

The first sensor 134 detects the water temperature at or near the inlet of the output pipe 116. If the water temperature detected by the first sensor 134 stays below the 142 degree temperature, then state 300 (FIG. 3A) is met. Alternatively, the state 300 may be met when the water temperature detected near the inlet of the output pipe 116 is just below the overheat temperature of 147 degrees Fahrenheit.

If a sufficient amount of fresh, cool or ambient temperature water flows into the bottom of the tank 102, then the water temperature begins to drop at the bottom of the tank 102. When the water temperature as detected by the second sensor 136 falls below the desired-setpoint temperature minus the first differential temperature (e.g., approximately 10 to 20 degrees Fahrenheit below the desired setpoint temperature), this improved two-sensor system may begin a heat cycle.

In the process, the logic unit 132 receives from the second sensor 136 signals indicating that the temperature at the bottom of the tank 102 is below the first-setpoint-temperature threshold 306, thereby meeting the state 302 (FIG. 3A). The logic unit 132 also receives from the first sensor 134 signals indicating the water temperature at the top of the tank 102 is below the maximum-temperature threshold 304.

In contrast, a legacy system with one sensor may initiate a heat cycle when the water temperature drops below the desired setpoint temperature minus a large differential amount (e.g., about 15 to 25 degrees Fahrenheit). In such a legacy system, its logic controller may cause its heater to heat the water even though the exiting water at the top of its tank may be above the maximum-temperature threshold 304, thereby operating inefficiently.

In an alternative embodiment of the present two-sensor water heater, a heat cycle may be initiated when the second sensor 136 detects a rapid drop in water temperature. This may happen even if the detected temperature is not below the first-setpoint-temperature threshold 306. A rapid drop in temperature may be defined by a change in cooling rate to approximately 1 to 5 degrees Fahrenheit per minute (deg. F./min.). The change in cooling rate, however, may be greater than or less than this exemplary range.

When both states 300 and 302 are met, the logic unit 132 may send to the gas-flow-valve actuator 138 a signal instructing it to open the gas-flow valve. If necessary, the logic unit 132 may send a signal to the ignition source 130 to light the gas. The ignition source 130 ignites the gas and the burner 128 heats the water in the tank 102.

The heater 108 will maintain heating the water when states 316 and 318 (FIG. 3D) are met. Thus, when the water temperature at the top of the tank 102 is less than 142 degrees Fahrenheit (i.e., the maximum-temperature threshold 304) and when the water temperature at the bottom of the tank 102, as sensed by the second sensor 136, is below 135 degrees Fahrenheit (i.e., the second-setpoint temperature 314), the logic unit 132 may send the gas-flow-valve actuator 138 signals for keeping open the gas-flow valve.

If, however, the water temperature detected by the second sensor 136 stays below 135 degrees Fahrenheit, but the water temperature detected by the first sensor 134 rises above 142 degrees Fahrenheit, then the heat cycle may be terminated. To terminate the heat cycle, the logic unit 132 may send to the gas-flow-valve actuator 138 signals to turn off the gas-flow valve. This prevents needless heating when the exiting water is at or near the desired setpoint temperature, saving energy and reducing the operating cost as compared to legacy systems.

When the water temperature at the bottom of the tank, as measured by the second sensor 136, rises above 135 degrees Fahrenheit or otherwise meets state 310 (FIG. 3C), the logic unit 132 may send the gas-flow-valve actuator 138 a signal for closing the gas-flow valve. Responsively, the gas-flow-valve actuator 138 closes the gas-flow valve and the flow of gas ceases, which in turn stops the burner 128 from continuing to heat the tank 102.

In some situations, the water heater 100 may receive multiple sequential demands for hot water. These sequential demands may only be for small amounts of water as compared to the total volumetric capacity of the water heater 100. For instance, a residential water heater may hold 40 gallons of water. Many of today's high efficiency appliances, such as dishwashers and clothes washers, only use about 5 to 15 gallon of hot water for a particular use (e.g., cleaning) cycle. When these appliances are operated simultaneously, the water heater may receive repeated demands for hot water in a relatively short amount of time.

In legacy water-heater systems, once the water temperature at the bottom of the tank drops below the setpoint, the heater cycle begins. Since the cold or ambient water entering the legacy water heater is approximately equal to the amount supplied for the demand, the heater may quickly heat the water at the bottom of the tank to the desired setpoint temperature and then shut off. With the repeated demands, temperature stacking can occur. The temperature stacking may be quite substantial and inefficient since the heater is cycled on and off when the temperature of the water at the top of the tank may be above the maximum-temperature threshold 304.

Unlike the legacy systems, the water heater 100 may be prevented from cycling on when state 308 (FIG. 3B) is met. When the logic unit 132 receives a signal from the first sensor 134 indicating that the temperature is greater than 142 degrees Fahrenheit, it sends a signal to gas-flow-valve actuator 138 to turn off the gas-flow valve or otherwise prevent the burner 128 from heating the tank 102. In addition to preventing the burner 128 from receiving gas, the logic unit 132 may also prevent the ignition source 130 from activating.

Cycling of the heater 108 may be prevented even if the logic unit 132 receives a signal from the second sensor 136 indicating that the water temperature at the bottom of the tank 102 is below the desired-setpoint temperature minus the differential temperature (i.e., state 302). Accordingly, temperature stacking and its resultant energy inefficiency may be reduced by employing the first sensor 134 and preventing needless heating when state 308 is met.

3. Experimental Results for a Water Heater with Two Sensor Control

Figure 4:
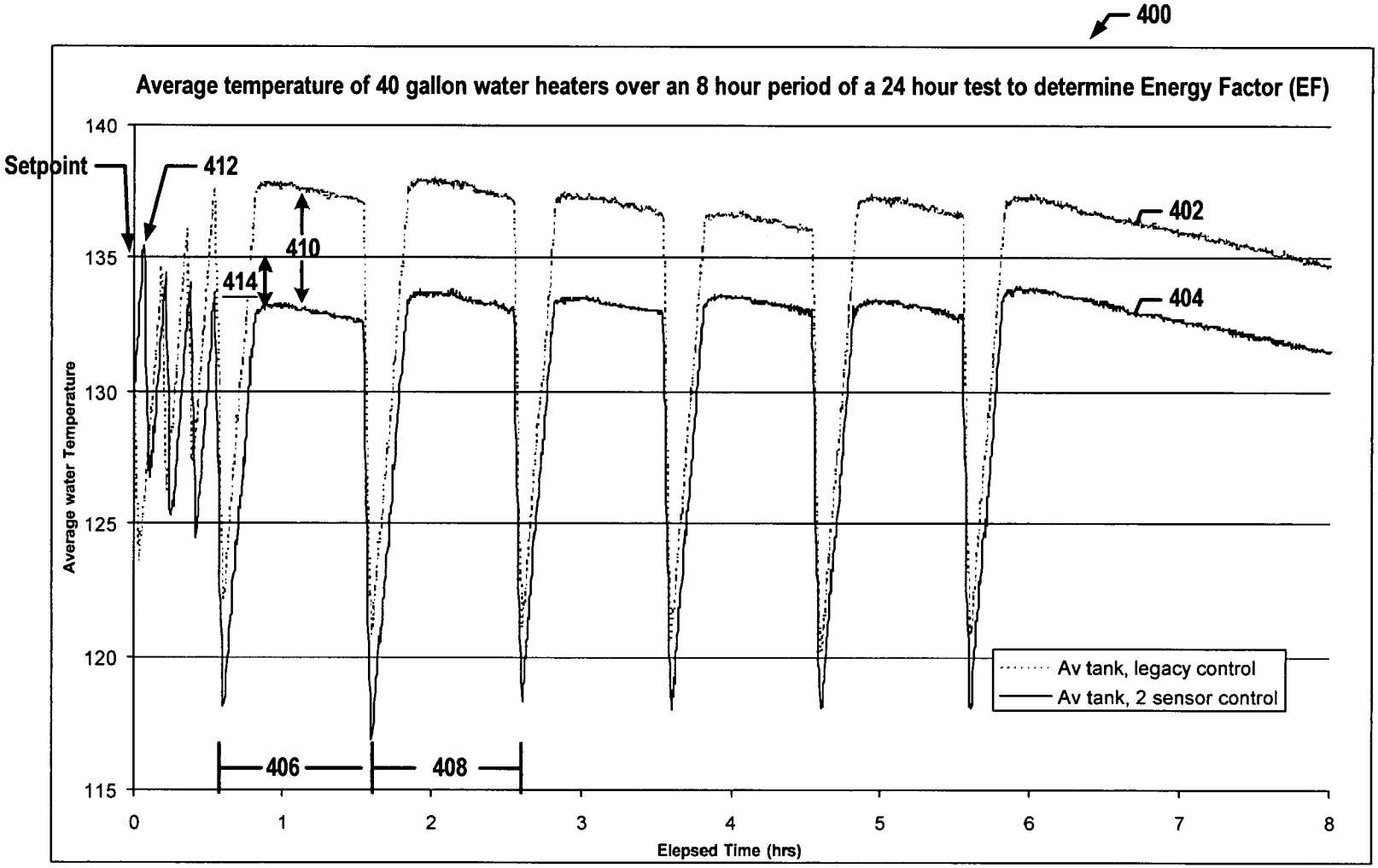
FIG. 4 is a first graph illustrating experimental results for the average temperature over a eight-hour period of a 24 hour simulated use test to determine the water heater's energy factor (EF) according to an exemplary embodiment.

FIG. 4 is a graph 400 illustrating experimental results for the average temperature over an eight hour period of a 24 hour simulated use test of two 40 gallon water heaters to determine the water heater's energy factor (EF) according to an exemplary embodiment. In FIG. 4, graph 400 includes a legacy system curve 402 that corresponds to the average temperature of a heater that uses a single-sensor-legacy-control system.

The average temperature shown by legacy system curve 402 is an average of water temperature of six temperature sensors vertically positioned in the tank 102. Each of the six temperature sensors is located in the middle of each of six sections that represent one sixth of the height of the tank 102.

Also illustrated in graph 400 is a two-sensor-control curve 404 that corresponds to the average temperature of six similarly mounted temperature sensors of the second of the two water heaters. The two-sensor-control curve 404 was produced using the two-sensor-control system as described above.

During part of period 406, the temperature of water in each of the water heaters drops below the desired setpoint temperature (e.g., 135 degrees Fahrenheit) minus the differential temperature. Thereafter, each of the water heaters begins a heat cycle. After the heating cycle completes, the legacy system curve 402 indicates that the average water temperature may rise several degrees above the desired setpoint temperature. Conversely, two-sensor-control curve 404 indicates that the average water temperature is approximately a few degrees below the desired setpoint temperature after the heating cycle has completed.

Over time, the temperature of the water decreases due to heat transfer to the outside world. At period 408, however, each water heater receives a demand for hot water. As the demand is fulfilled, a sufficient amount of cold or ambient temperature water rushes in, which causes each of the water heaters to begin a second heating cycle. While the two-sensor-control curve 404 indicates that the average water temperature is slightly lower the desired setpoint temperature, the water drawn from output pipe 116 will be at or slightly above the desired setpoint temperature.

4. Heater Control Zones

Figure 5:
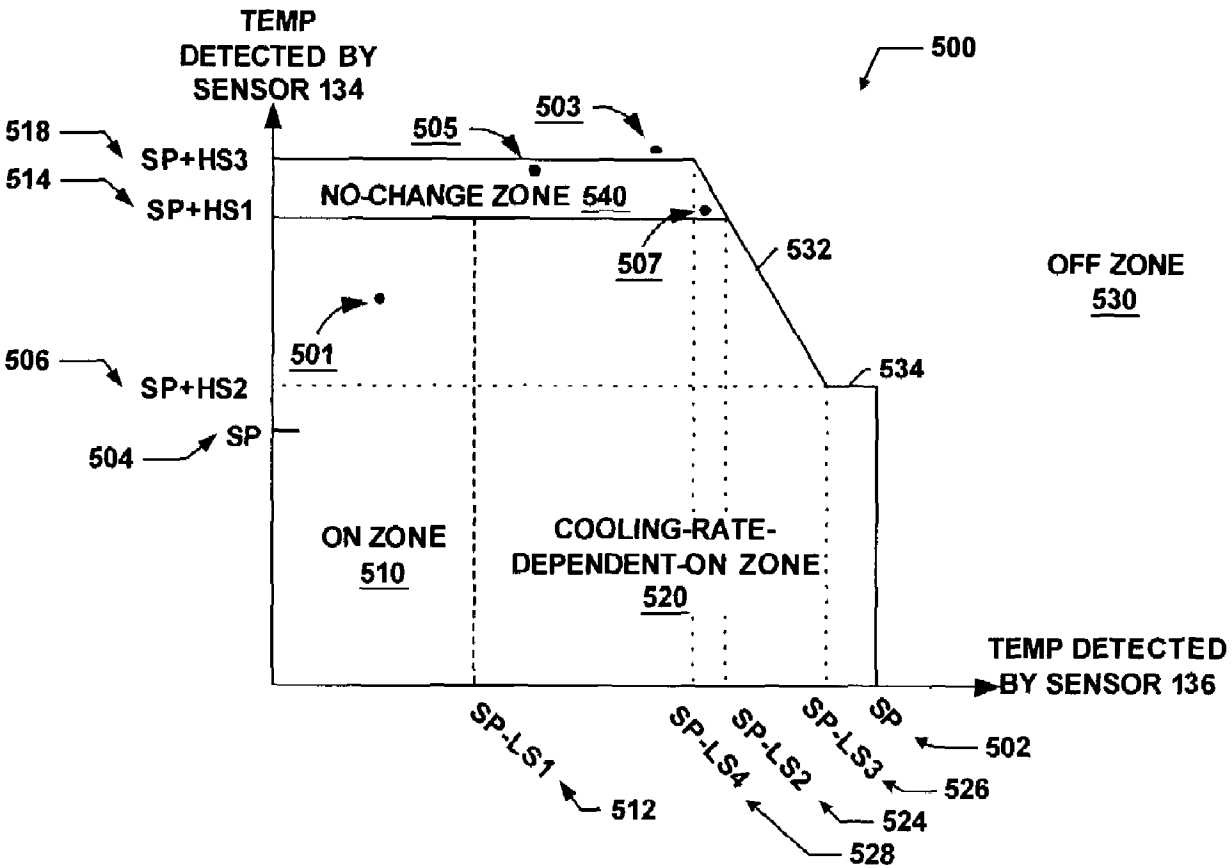
FIG. 5 is a second graph illustrating a plurality of heater-control zones for controlling a water heater having a two-sensor heater control assembly according to an exemplary embodiment.

FIG. 5 is a graph 500 illustrating a plurality of heater-control zones for controlling a water heater having a two-sensor heater control assembly in accordance with an exemplary alternative embodiment. Included in the plurality of heater-control zones is an "ON" zone 510; a "COOLING-RATE-DEPENDENT-ON" zone 520; an "OFF" zone 530; and a "NO-CHANGE" zone 540.

Each of the heater-control zones may delimit a group of water temperatures. When the water temperature of the water heater falls within this collective range of water temperatures, the first and/or second sensor 134, 136 may signal the heater control assembly 110 to drive the heater 108 to an on state, an off state, or alternatively, to maintain the current state of heater 108. Further, the delimited boundaries of each of the heater-control zones may be defined by one or more temperature thresholds for the water temperature detected by the first and second sensors 134, 136.

The temperature thresholds for the first sensor 134 may include a first-sensor-setpoint threshold 504, a first-sensor-first threshold 514, a first-sensor-second threshold 506, and a first-sensor-cut-off threshold 518. The temperature thresholds for the second sensor 136 may include a second-sensor-setpoint threshold 502, a second-sensor-first threshold 512, a second-sensor-second threshold 524, a second-sensor-third threshold 526, and a second-sensor-fourth threshold 528.

The first-sensor-setpoint threshold 504 and the second-sensor-setpoint threshold 502 may be desired-setpoint thresholds for the first and second sensors 134, 136, respectively. The desired-setpoint thresholds 502, 504 may be the same or different temperature. In an exemplary embodiment, both of the desired-setpoint thresholds 502, 504 may be, for example, a user selected threshold of about 135 degrees Fahrenheit. The desired-setpoint thresholds 502, 504, however, may differ from this 135 degree Fahrenheit example.

Each of the other thresholds may be a function of the first-sensor and second-sensor setpoint thresholds 502, 504. For example, each of the other thresholds may be equal to the first-sensor and the second-sensor setpoint thresholds 502, 504 plus or minus a differential temperature. Table 1 (below) illustrates such an example.

TABLE 1

| Threshold Name | Threshold Label | Differential | Exemplary Differential Value (Degrees Fahrenheit) |
|---|---|---|---|
| First-sensor-setpoint threshold 504 | SP | N/A | 135 |
| First-sensor-first threshold 514 | SP + HS1 | HS1 | 5 to 10 |
| First-sensor-second threshold 506 | SP + HS2 | HS2 | 0 to 1 |
| First-sensor-cut-off threshold 518 | SP + HS3 | HS3 | 5 to 15 |
| Second-sensor-setpoint threshold 502 | SP | N/A | 135 |
| Second-sensor-first threshold 512 | SP − LS1 | −LS1 | 10 to 20 |
| Second-sensor-second threshold 524 | SP − LS2 | −LS2 | 5 to 10 |
| Second-sensor-third threshold 526 | SP − LS3 | −LS3 | 0 to 3 |
| Second-sensor-fourth threshold 528 | SP − LS4 | −LS4 | 10 to 12 |

The differential values for the thresholds listed in Table 1, however, are not limited to these exemplary embodiments, but may be other values as well. Moreover, the delimited boundaries of each of the heater-control zones may be defined as a function of the above-listed temperature thresholds. For example, boundary 532 may be based on an average of the second-sensor-third threshold 526 and the first-sensor-second threshold 506. The average temperature is a constant on boundary 532.

Also shown in FIG. 5 is step boundary 534. Step boundary 534 may be used to ensure that water drawn from the tank after a heating cycle is at or slightly above the desired setpoint temperature even though the average water temperature in the tank 102 is controlled at approximately the desired setpoint temperature. A lower average temperature may reduce heat loss to the ambient surroundings, and thus, improve energy efficiency.

In the exemplary embodiment shown in FIG. 5, the step boundary 534 is a horizontal section of the boundary delineated by first-sensor-second threshold 506 located between the second-sensor-third threshold 526 and the second-sensor-setpoint threshold 502. The step boundary 534 may be set at a value to lower the average temperature boundary (e.g., boundary 532) a couple of degrees Fahrenheit below the desired setpoint temperature. This value may vary depending on the configuration and other physical attributes of the water heater. Preferably, the step boundary 534 is set approximately 0 to 3 degrees Fahrenheit wide.

During initial heating, the water temperatures detected by the first and second sensors 134, 136 closely track each other. These water temperatures will continue to rise up until the point at which the water heater enters the "OFF" zone 530 (e.g., the point at which the water temperatures exceed the second-sensor-setpoint threshold 502 and the first-sensor-second threshold 506). This control is illustrated in FIG. 4 at point 412, where the two-sensor-control curve 404 initially exceeds the preferred 135 degree Fahrenheit setpoint temperature.

After some water is drawn from the tank 102 and cooler water is drawn into the bottom of the tank, an upper to lower temperature differential may build. After each successive reheating, the temperatures as detected by the first and second sensors 134, 136 may rise to just above the boundary 532. Yet, the average temperature may be approximately 0 to 3 degrees Fahrenheit lower than the desired setpoint. In the exemplary embodiment shown in FIG. 4, this is represented by the difference 414, which is preferably about 1.5 degrees Fahrenheit lower than the setpoint. The difference of the averages 410 of the legacy system curve 402 and two-sensor-control curve 404 demonstrates that the average water temperature using the legacy control is greater than the average water temperature using the present two-sensor-controlled water heater. The present two-sensor controlled water heater, nonetheless, maintains the average water temperature at just below the desired setpoint temperature, whereas the legacy water heater maintains the average temperature above the desired water temperature. Thus, given that the temperature as detected by sensor 134 and the supply of water from the output pipe 116 can be delivered at or slightly above the desired setpoint temperature, the current two-sensor-controlled water exhibits improved energy efficiency (e.g., less heat loss to the ambient environment) as compared with the legacy control.

A. ON Zone

When the first and second sensors 134, 136 detect a water temperature within the ON zone 510, then the logic unit 132 may either initiate a heat cycle or maintain a previously initiated heat cycle. This may occur when (i) the second sensor 136 detects a water temperature that is less than the second-sensor-first threshold 512 and (ii) the first sensor 134 detects a water temperature that is less than the first-sensor-first threshold 514. Point 501 is an example of such condition.

B. OFF Zone

When the first and/or second sensor 134, 136 detects a water temperature within the OFF zone 530, then the logic unit 132 may halt any ongoing heat cycle or prevent a heat cycle from starting. Point 503 defines a coordinate within the OFF zone 530.

C. NO-CHANGE Zone

When the first and second sensors 134, 136 detect a water temperature within the NO-CHANGE zone 540 after exiting from the OFF zone 530, the logic unit 132 prevents the water heater from initiating a heat cycle. Preventing a heat cycle under these conditions may prevent needlessly heating water that may be at or above the desired setpoint temperature. This may be the case when the water temperature drops from point 503 to point 505. At point 505, the second sensor 136 detects a water temperature that is less than the second-sensor-fourth threshold 528, and the first sensor 134 detects a water temperature that between the first-sensor-first threshold 514 and the first-sensor-cut-off threshold 518.

Alternatively, when the first and second sensors 134, 136 detect a water temperature within the NO-CHANGE zone 540 after exiting the ON zone 510 or the COOLING-RATE-DEPENDENT-ON zone 520, the logic unit 132 may maintain the previously initiated heat cycle. In this instance, the NO-CHANGE zone may provide heat-hysteresis control and limit cycling the heater when the water temperature oscillates around the desired-setpoint temperature.

Point 507 illustrates the condition where the first and second sensors 134, 136 detect a water temperature within the NO-CHANGE zone 540 after exiting from the COOLING-RATE-DEPENDENT-ON zone 520. At point 507, the second sensor 136 detects a water temperature that is less than the second-sensor-second threshold 524 and the first sensor 134 detects a water temperature that is between the first-sensor-first threshold 514 and the first-sensor-cut-off threshold 518.

D. COOLING-RATE-DEPENDENT-ON Zone

When the first and second sensors 134, 136 detect a water temperature within the COOLING-RATE-DEPENDENT-ON zone 520 after exiting the OFF zone 530 or the NO-CHANGE zone 540, the logic unit 132 may maintain the current off state of the heater 108. Alternatively, the logic unit 132 may initiate a heat cycle when the water cools at a rate exceeding a cooling rate threshold.

The cooling rate threshold may be a threshold for comparing the rate of change of the average water temperature measured by the first and second sensors 134, 136 as the water in the tank 102 cools. In an exemplary embodiment, the cooling rate threshold may be approximately 2 degrees Fahrenheit per minute. The cooling rate threshold may be other rates as well. Further, the cooling rate threshold may be an asymmetric condition. The asymmetry may depend on whether the water heater enters the COOLING-RATE-DEPENDENT-ON zone 520 from the ON zone 510, the OFF zone 530, and/or the NO-CHANGE zone 520.

The first of the asymmetric conditions occurs when the water heater enters the COOLING-RATE-DEPENDENT-ON zone 520 from the OFF zone 530 and/or the NO-CHANGE zone 540. When entering from either of these zones, the water may be cooling, and thus, a cooling rate can be detected. The cooling rate threshold may be satisfied when the first and second sensors 134, 136 detect an average rate of change that is greater than the cooling rate threshold.

Figure 6:
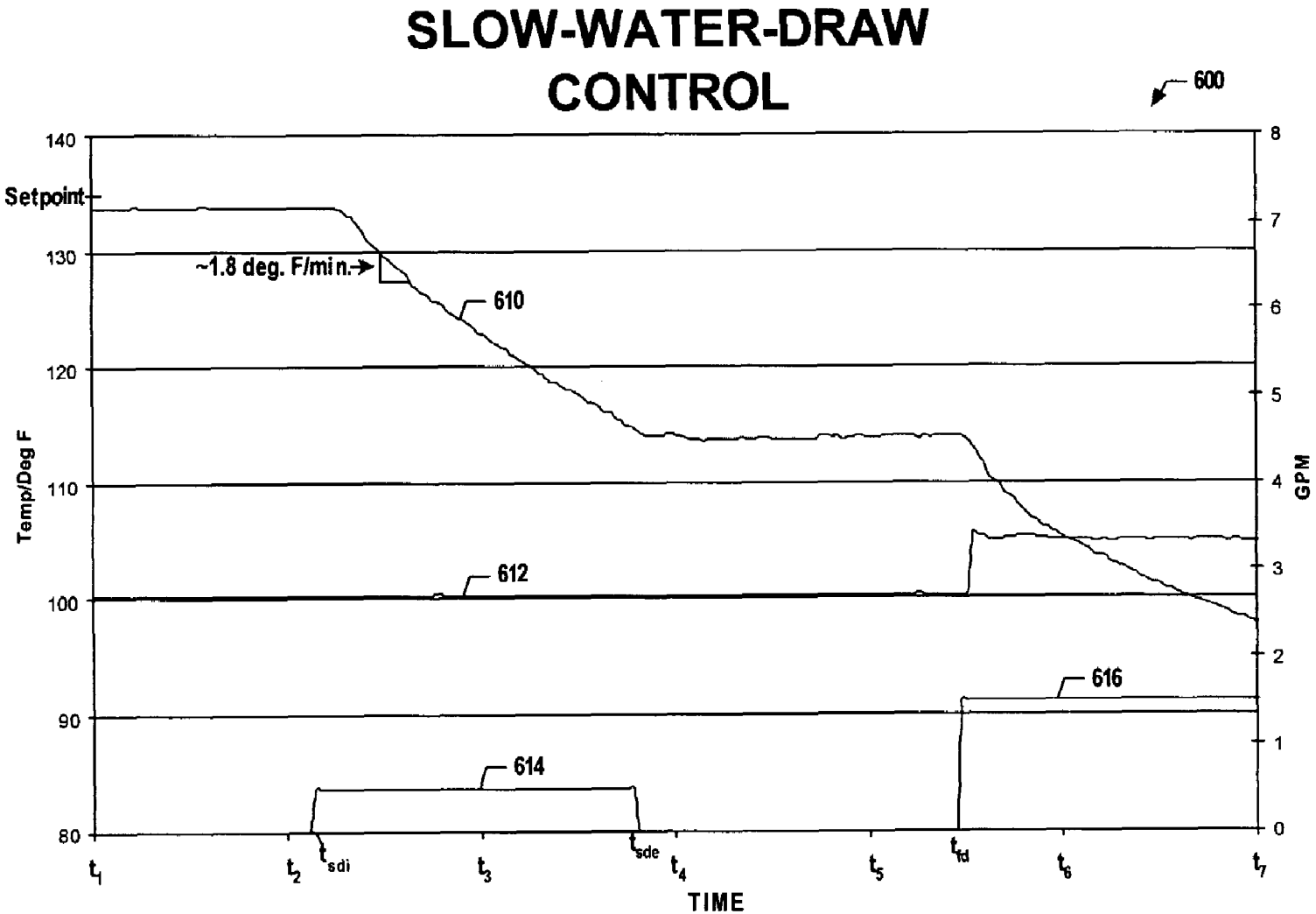
FIG. 6 is a third graph illustrating slow-water-draw control of a water heater having a two-sensor heater control assembly according to an exemplary embodiment.
Figure 7:
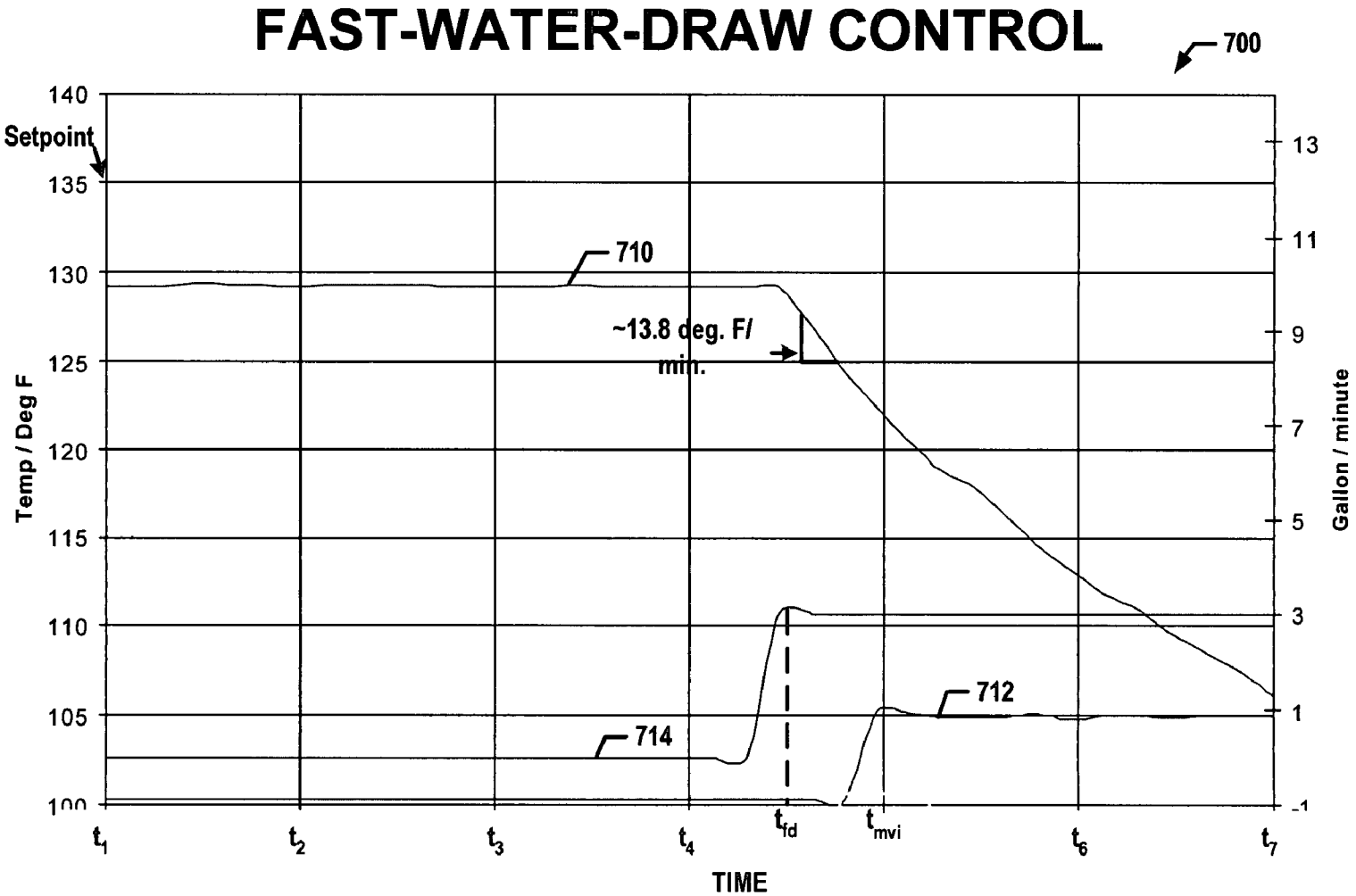
FIG. 7 is a fourth graph illustrating fast-water-draw control of a water heater having a two-sensor heater control assembly according to an exemplary embodiment.

The following examples indicate how the cooling rate of change threshold may be implemented. These examples may be illustrated with reference to FIGS. 6 and 7. FIG. 6 is a graph 600 illustrating slow-water-draw control of a water heater having a two-sensor heater control assembly according to an exemplary embodiment. FIG. 7 is a graph 700 illustrating fast-water-draw control of a water heater having a two-sensor heater control assembly according to an exemplary embodiment. For exemplary purposes only, the cooling rate of change threshold is 2 deg. F./min. in the following examples.

(1) Example 1

Curve 610 illustrates a water temperature detected by the second sensor 136 over a period of approximately 0.6 hours or 36 minutes. Curve 612 represents the "ON" and/or "OFF" condition of the heater 108, as measured from the open and/or closed state of the gas-flow-valve actuator 138. During the period between $t_1$ and $t_{fd}$, the heater 108 is off, and between $t_{fd}$ and $t_7$, the heater 108 is on. Curve 614 represents a slow water draw of about 0.5 gallons per minute. The curve 614 illustrates a condition that is indicative of one or more low rate and/or short duration demands for water. Curve 616 represents a fast water draw, which may be a condition that is indicative of one or more high rate and/or long duration demands for water.

As can be seen in FIG. 6, shortly after the initiation of the slow water draw at $t_{sdi}$, the temperature near or at the bottom of the tank 102 (as may be detected by the second sensor 134) begins to fall. During this slow water draw, the temperature at or near the bottom of the tank 102 decays as illustrated by the downward sloping portion of the curve 610 between $t_{sdi}$ and $t_{sde}$. In this example, the decay pattern represents the average rate of change over the period between $t_{sdi}$ and $t_{sde}$ and is approximately 1.8 deg. F./min. The slow water draw may cause the water temperature to decay at different rates. In addition, the decay pattern may differ from that shown.

Conspicuously, the heater 108 remains off during the decay period between $t_{sdi}$ and $t_{sde}$, as illustrated by curve 612. After the slow water draw completes, the decay of the water temperature ceases. Thereafter, the temperature of the water remains substantially constant until the large water draw occurs at $t_{fd}$. The substantially constant portion of the curve 610 is illustrated by the horizontal portion of curve 610 between $t_{sde}$ and $t_{fd}$.

While the water temperature as detected by the second sensor 136 decayed from the desired setpoint temperature (e.g., 135 degrees Fahrenheit), the heater 108 did not cycle on until the large water draw caused the water temperature to drop below the second-sensor-first threshold 512. (And, of course, the temperature at the top of the tank 102 also satisfies the conditions of ON zone 510.) Thus, the average rate of change of the water temperature between $t_{sdi}$ and $t_{sde}$ did not exceed the cooling rate threshold. By not exceeding the cooling rate threshold, frequent operation of the gas-flow-valve actuator 138 and in turn firing the heater are prevented, thereby improving the efficiency of the water heater 100.

In an alternative embodiment (not shown), when a large amount of low rate and short duration demands for water draw are called for, the water temperature as detected by the second sensor 136 may decay at a rate similar to the decay pattern shown in curve 610 between the period of $t_{sdi}$ and $t_{sde}$. The decay pattern may also include periods where the decay levels off. In this case, the average rate of change might not exceed the cooling rate threshold as well. Consequently, the logic unit 132 might not initiate a heat cycle, until entering the ON zone 510. Given that the heating rate, which may be about 1 to 2 degrees Fahrenheit per minute, is generally the same or higher than the cooling rate, the supply of hot water should not be interrupted.

(2) Example 2

Referring now to FIG. 7, curve 710 illustrates a water temperature detected by the second sensor 136 over a period of approximately 0.1 hours or 6 minutes. Curve 712 represents the "ON" and/or "OFF" condition of the heater 108, as measured from the open and/or closed state of the gas-flow-valve actuator 138 during the same period. During the period between $t_i$ and $t_{mvi}$, the heater 108 is off, and between $t_{mvi}$ and $t_7$, the heater 108 is on. Curve 714 represents a fast water draw, which may be a condition indicative of one or more high rate and/or long duration demands for water.

As can be seen in FIG. 7, a short time after the initiation of the fast water draw at $t_{fd}$, the temperature near or at the bottom of the tank 102 as detected by the second sensor 136 begins to fall. During the fast water draw, the temperature at or near the bottom of the tank 102 decays rapidly as illustrated by the sharp downward sloping portion of the curve 710 between $t_{fd}$ and $t_{mvi}$ (or between $t_{fd}$ and $t_7$).

In this example, the decay pattern or the average rate of change over the period between $t_{fd}$ and $t_{mvi}$ is approximately 13.8 deg. F./min., which is greater than the cooling rate of change threshold of approximately 2 deg. F./min. Thus, the average rate of change of the water temperature between $t_{fd}$ and $t_{mvi}$ exceeds the cooling rate of change threshold. By exceeding the cooling rate of change threshold under this high rate of change condition, the logic unit 132 may signal the gas-flow-valve actuator 138 to turn on.

Unlike the slow water draw condition, the heater 108 turns on at a temperature within the COOLING-RATE-DEPENDENT-ON zone 520 (e.g., 122 degrees Fahrenheit). In effect, the logic unit 132 anticipates that the water temperature as measured by the second sensor 136 will enter the ON zone 510 before the water temperature actually reaches the second-sensor-first threshold 512. Responding to the large rate of change and initiating a heat cycle at $t_{mvi}$ may increase the water heater's delivery capacity of hot water.

As noted, the cooling rate of change threshold may be an asymmetric condition that depends upon the zone from which the water heater enters the COOLING-RATE-DEPENDENT-ON zone 520. When entering from ON zone, the water is being heated, so the cooling-rate dependent condition does not apply. When the first and second sensors 134, 136 detect a water temperature within the COOLING-RATE-DEPENDENT-ON zone 520 after exiting the ON zone 510, the logic unit 132 may maintain the previously initiated heat cycle. As such, the logic unit 132 may signal the gas-flow-valve actuator 138 to remain on. This signal may remain until the water temperature enters the OFF zone 530.

Figure 8:
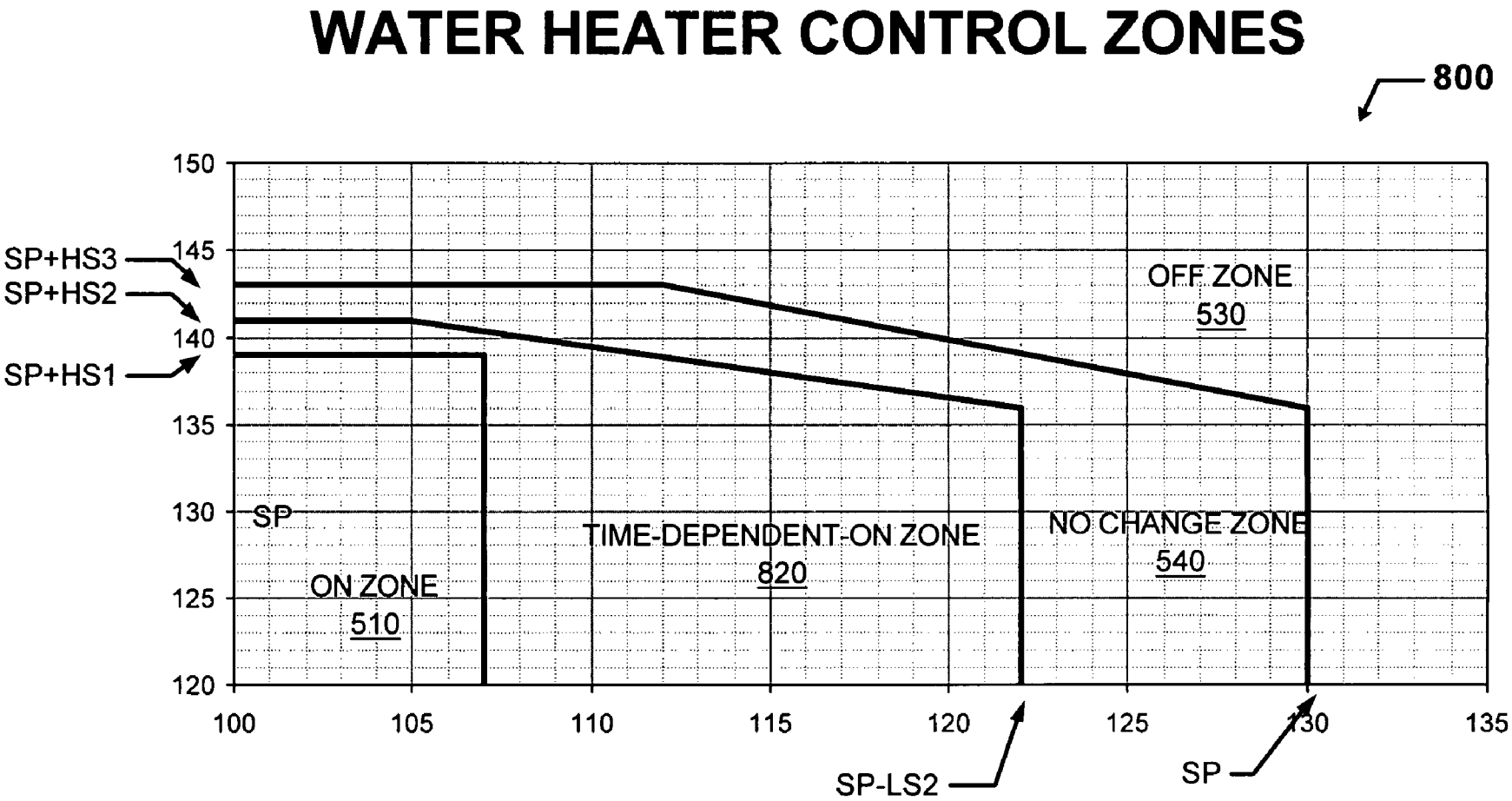
FIG. 8 is a fifth graph illustrating a plurality of heater-control zones for controlling a water heater having a two-sensor heater control assembly in accordance with another exemplary alternative embodiment.

FIG. 8 is a graph 800 illustrating a plurality of heater-control zones for controlling a water heater having a two-sensor heater control assembly in accordance with another exemplary alternative embodiment. Included in the plurality of heater-control zones is the "ON" zone 510; a "TIME-DEPENDENT-ON" zone 820; the "OFF" zone 530; and the "NO-CHANGE" zone 540.

The heater-control zones of FIG. 8 are similar in most respects to the heater-control zones of FIG. 5, except as described herein. While the functions that define the boundaries of the TIME-DEPENDENT-ON zone 820 and the COOLING-RATE-DEPENDENT-ON zone 520 are similar or substantially the same, the TIME-DEPENDENT-ON zone 820 differs from the COOLING-RATE-DEPENDENT-ON zone 520 by the addition of another threshold, namely a time-dependent threshold. Like the cooling rate threshold, the time-dependent-threshold is an asymmetric threshold. The asymmetry may depend on the amount of time the water heater remains off.

For example, when entering the TIME-DEPENDENT-ON zone 820 from the ON zone 510, the logic unit 132 may maintain the current heat cycle. If entering the TIME-DEPENDENT-ON zone 820 from the OFF zone 530 and/or the NO-CHANGE zone 540, then the logic unit 132 may maintain the current off state if the off time is longer than the time-dependent threshold. Alternatively, when the heater 108 has been off for a period shorter than the time-dependent threshold, then the TIME-DEPENDENT-ON zone 820 may mimic or otherwise emulate the ON zone 510. In practice, however, the TIME-DEPENDENT-ON zone 820 and the COOLING-RATE-DEPENDENT-ON zone 520 are different embodiments, which may or may not be used concurrently.

Like the COOLING-RATE-DEPENDENT-ON zone 520, the thresholds of the TIME-DEPENDENT-ON zone 820 may be variable. For instance, the boundaries may be continually adjusted by varying the differential settings from a default value to another value (e.g., from LS1 to LS4) when there is no call for heat during a given period. For instance, one or more of the thresholds of the TIME-DEPENDENT-ON zone 820 may be adjusted incrementally by adding or subtracting a predetermined number of degrees per unit time (e.g., an hour) from the threshold.

Figure 10:
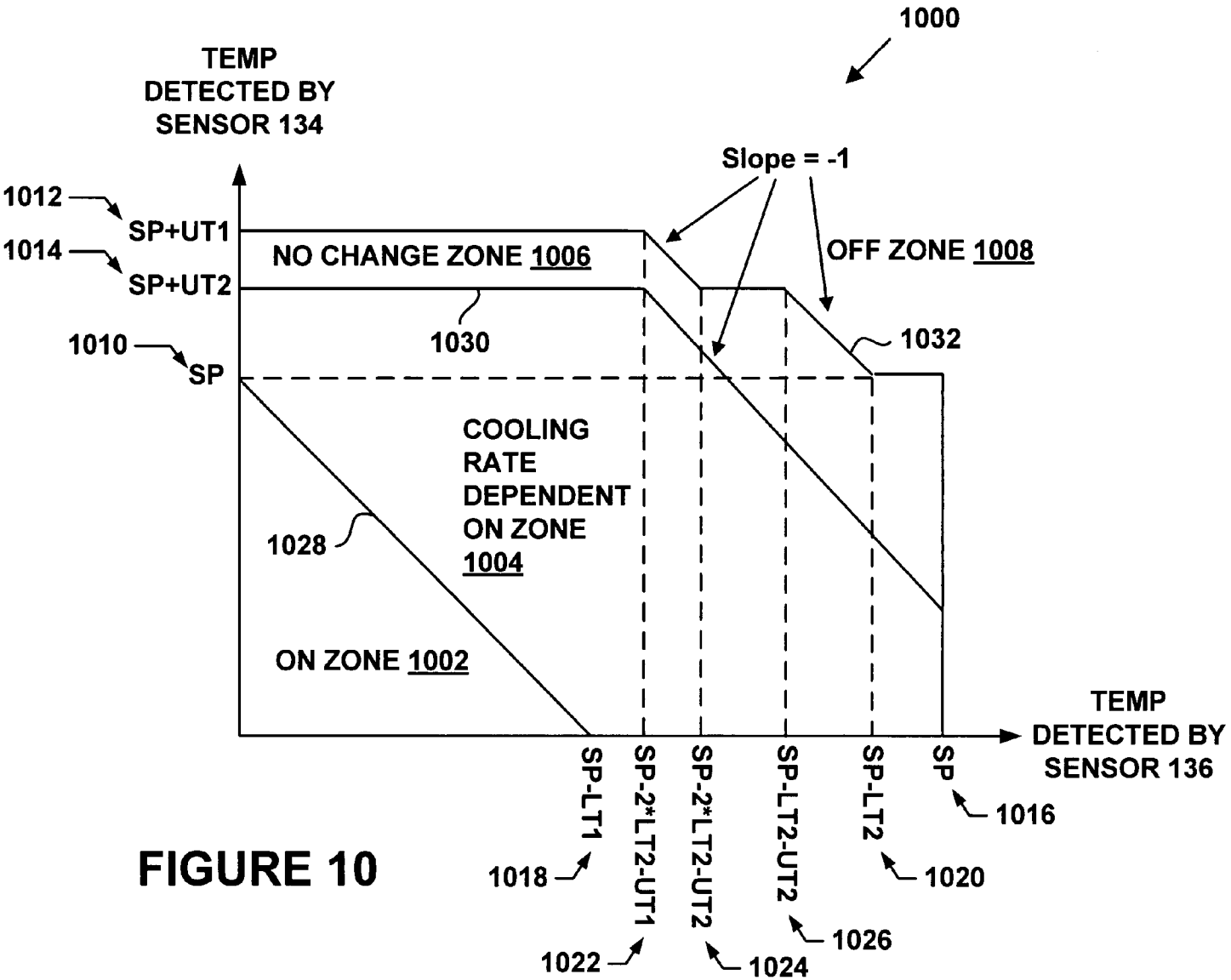
FIG. 10 is a sixth graph illustrating a plurality of heater-control zones for controlling a water heater having a two-sensor heater control assembly in accordance with another example.

FIG. 10 is a graph 1000 illustrating a plurality of heater-control zones for controlling a water heater having a two-sensor heater control assembly. In this example, a temperature control algorithm may be dynamically adjusted based on average water temperature, water draw time, and heat cycle time of the gas-flow-valve actuator 138. The temperature control algorithm may also include a first setpoint differential (UT1) adjustment based on the water draw time and a second setpoint differential (LT1) adjustment based on water cycle time.

The temperature control algorithm may be implemented in software as part of the programmable instructions included in the logic unit 132. The logic unit 132 may receive inputs from the first and second sensors 134, 136 and provide as an output a signal that controls the gas-flow-valve actuator 138. The logic unit 132 may store the temperature data obtained from the first and second sensors 134, 136. As a result, the logic unit 132 may have access to both current and historical temperature data received from the first and second sensors 134, 136. With this data, the logic unit 132 may use temperature change rates to determine when a water draw occurs, and estimate a water draw rate and a water draw time.

In addition, the logic unit 132 may store the output signals used to control the gas-flow-valve actuator 138. As a result, the logic unit 132 may be able to calculate on-time, off-time, and heat cycle time of the gas-flow-valve actuator 138. The logic unit 132 may then process the temperature data and on-time and off-time of the gas-flow-valve actuator using the temperature control algorithm. The temperature control algorithm may be used for controlling the gas-flow-valve actuator 138 and adjusting the setpoint differentials (UT1, LT1) as needed.

The temperature control algorithm may be more clearly explained with reference to FIG. 10. The graph 1000 depicts four heater-control zones. The heater-control zones include an "ON" zone 1002, a "COOLING-RATE-DEPENDENT-ON" zone 1004, a "NO-CHANGE" zone 1006, and an "OFF" zone 1008. Each of the heater-control zones may delimit a group of water temperatures. When the water temperature of the water heater, as sensed by temperature sensors 134 and 136, falls within this collective range of water temperatures, the heater control assembly 110 may drive the heater 108 to an on state, an off state, or alternatively, to maintain the current state of heater 108. Further, the delimited boundaries of each of the heater-control zones 1002-1008 may be defined by one or more temperature thresholds for the water temperatures detected by the first and second sensors 134, 136.

The graph 1000 has a first axis (y-axis) in which the temperatures detected by the first sensor 134 are plotted and a second axis (x-axis) in which the temperatures detected by the second sensor 136 are plotted. The y-axis includes three temperature thresholds: a first-sensor setpoint threshold ("SP") 1010, a first-sensor-first threshold ("SP+UT1") 1012, and a first-sensor-second threshold ("SP+UT2") 1014. The x-axis includes six temperature thresholds: a second setpoint threshold ("SP") 1016, a second-sensor-first threshold ("SP-LT1") 1018, a second-sensor-second threshold ("SP-LT2") 1020, a second-sensor-third threshold ("SP-2*LT2-UT1") 1022, a second-sensor-fourth threshold ("SP-2*LT2-UT2") 1024, and a second-sensor-fifth threshold ("SP-LT2-UT2") 1026.

The first-sensor and the second-sensor-setpoint thresholds 1010, 1016 may be desired setpoint thresholds for the first and second sensors 134, 136, respectively. The first-sensor and the second-sensor-setpoint thresholds 1010, 1016 may be the same or different temperatures. For example, the first-sensor and the second-sensor-setpoint thresholds 1010, 1016 may be a user selected threshold of about 135 degrees Fahrenheit. However, the first-sensor and second-sensor-setpoint thresholds 1010, 1016 may differ from this 135 degree Fahrenheit example.

Each of the other thresholds may be a function of the first-sensor and the second-sensor-setpoint thresholds 1010, 1016. For example, each of the other thresholds may be equal to the first-sensor and the second-sensor-setpoint thresholds 1010, 1016 plus or minus a differential temperature. Table 2 (below) illustrates such an example.

TABLE 2

| Threshold Name | Threshold Label | Differential | Example Differential Value (Degrees Fahrenheit) |
|---|---|---|---|
| First-sensor-setpoint threshold 1010 | SP | N/A | 135 |
| First-sensor-first threshold 1012 | SP + UT1 | UT1 | 0 to 8 |
| First-sensor-second threshold 1014 | SP + UT2 | UT2 | 0 to 6 |
| Second-sensor-setpoint threshold 1016 | SP | N/A | 135 |
| Second-sensor-first threshold 1018 | SP − LT1 | −LT1 | 7 to 20 |
| Second-sensor-second threshold 1020 | SP − LT2 | −LT2 | 0 to 3 |
| Second-sensor-third threshold 1022 | SP − 2 * LT2 − UT1 | −2 * LT2 − UT1 | Calculate from above |
| Second-sensor-fourth threshold 1024 | SP − 2 * LT2 − UT2 | −2 * LT2 − UT2 | Calculate from above |
| Second-sensor-fifth threshold 1026 | SP − LT2 − UT2 | −LT2 − UT2 | Calculate from above |

The differential values for the thresholds listed in Table 2, however, are not limited to these examples, but may be other values as well.

The UT1 differential may typically be set to a default value of eight degrees Fahrenheit. The UT2 differential may typically be set to approximately two degrees Fahrenheit less than the UT1 differential. The temperature control algorithm may adjust the value of the UT1 differential based on the water draw time. As the water draw time increases, the UT1 differential may be reduced to a minimum of zero degrees Fahrenheit. The UT2 differential may also be reduced to maintain the two degree Fahrenheit difference from the UT1 differential until the UT2 differential reaches zero degrees Fahrenheit. By adjusting the UT1 differential, the amount of temperature stacking allowed in the tank 102 may also be adjusted.

The LT1 differential may typically be set to a default value of twenty degrees Fahrenheit. If a maximum time between water draws is within a window of time, then the LT1 differential may be reduced. If the maximum time between water draws is not within this window of time, then the LT1 differential may remain at the default value. For example, the window of time may be five to ten hours between water draws. If the maximum time between water draws is within this window, the LT1 differential may be reduced from twenty degrees Fahrenheit to seven degrees Fahrenheit. Once the LT1 differential has been adjusted to the reduced value, the LT1 differential may remain there until the time between two consecutive water draws exceeds the maximum for the window—ten hours in this example. However, other windows of time and temperature differential values may be used.

The detection of water draws and consequential adjustment of LT1 differential improves the overall accuracy of the temperature control algorithm. In most cases the heater 108 is in idle for much of the night allowing the temperature in the tank 102 to slowly cool down to as low of a temperature as setpoint minus LT1 differential. By using the maximum time between water draws to reduce this value the outlet water temperature will be much closer to the desired setpoint and provide much better performance to the user. If the demand for water is lower and time between water draws is very long, then the LT1 differential is not adjusted and the tank 102 operates more efficiently. Boundaries of each of the heater-control zones may be defined as a function of the above-listed temperature thresholds. The boundaries include a first boundary 1028, a second boundary 1030, and a third boundary 1032. The first boundary 1028 may be located between the ON zone 1002 and the COOLING RATE DEPENDENT ON zone 1004. The first boundary 1028 may be a line that slopes from the first-sensor-setpoint threshold 1010 to the second-sensor-first threshold 1018.

The second boundary 1030 may be located between the COOLING RATE DEPENDENT ON zone 1004 and both the NO CHANGE zone 1006 and the OFF zone 1008. The second boundary 1030 may be a horizontal line located at the first-sensor-second threshold 1014 until the second boundary 1030 reaches the second-sensor-third threshold 1022. At the second-sensor-third threshold 1022 and continuing to the second-sensor-setpoint threshold 1016, the second boundary 1030 may be a line that slopes downwardly. The slope of the second boundary 1030 in this area may be approximately −1. When the second boundary 1030 reaches the second-sensor-setpoint threshold 1016, the second boundary 1030 may be a vertical line.

The third boundary 1032 may be located between the NO CHANGE zone 1006 and the OFF zone 1008. The third boundary 1032 may be a horizontal line located at the first-sensor-first threshold 1012 until the third boundary 1032 reaches the second-sensor-third threshold 1022. At the second-sensor-third threshold 1022 and continuing to the second-sensor-fourth threshold 1024, the third boundary 1032 may be a line that slopes downwardly. The slope of the third boundary 1032 in this area may be approximately −1.

When the third boundary 1032 reaches the second-sensor-fourth threshold 1024, the third boundary 1032 may be a horizontal line located at the first-sensor-second threshold 1014 until the third boundary 1032 reaches the second-sensor-fifth threshold 1026. At the second-sensor-fifth threshold 1026 and continuing to the second-sensor-second threshold 1020, the third boundary 1032 may be a line that slopes downwardly. The slope of the third boundary 1032 in this area may be approximately −1.

When the third boundary 1032 reaches the second-sensor-second threshold 1020, the third boundary 1032 may be a horizontal line located at the first-sensor-setpoint threshold 1010 until the third boundary 1032 reaches the second-sensor-setpoint threshold 1016. When the third boundary 1032 reaches the second-sensor-setpoint threshold 1016, the third boundary 1032 may be a vertical line. The two sloped line segments in the third boundary 1032, which may be described as a double step down function, may further improve the efficiency of the water heater by further controlling the temperature stacking in the tank 102 while maintaining a fairly consistent average tank temperature.

When the first and second sensors 134, 136 detect a water temperature within the ON zone 1002, then the logic unit 132 may either initiate a heat cycle or maintain a previously initiated heat cycle. When the first and/or second sensors 134, 136 detect a water temperature within the OFF zone 1008, then the logic unit 132 may halt any ongoing heat cycle or prevent a heat cycle from starting. When the first and second sensors 134, 136 detect a water temperature within the NO-CHANGE zone 1006, the logic unit 132 may maintain the water heater 100 in the previous state (i.e., maintains a previously initiated heat cycle or prevents a heat cycle from starting).

The temperature control algorithm may disable the COOLING-RATE-DEPENDENT-ON zone 1004 based on the average water temperature, the water draw time, and the heat cycle time. For example, the COOLING-RATE-DEPENDENT-ON zone 1004 may be enabled when initially applying power to the water heater 100; when the gas-flow-valve actuator 138 has been off for a long period of time, such as greater than five hours; when the gas-flow-valve actuator 138 has been off for less than a short period of time, such as thirty minutes; and when the average water temperature is low, such as fifteen degrees below the first-sensor and second-sensor-setpoint thresholds 1010, 1016.

For example, the COOLING-RATE-DEPENDENT-ON zone 1004 may be enabled whenever the gas-flow-valve actuator 138 off time is less than thirty minutes or greater than five hours, and the average water temperature is fifteen degrees less than the first-sensor and second-sensor-setpoint thresholds 1010, 1016. Otherwise, the COOLING-RATE-DEPENDENT-ON zone 1004 may be disabled. By disabling the COOLING-RATE-DEPENDENT-ON zone 1004 when not needed, the logic unit 132 may delay turning on the gas-flow-valve actuator 138, which may improve efficiency of the water heater 100. While improving efficiency, this feature maintains performance for frequent use periods (less than 30 minutes burner off time) and for long durations without usage (greater than 5 hours burner off time) by starting a heat cycle quickly to ensure faster recovery in such times.

When the COOLING-RATE-DEPENDENT-ON zone is enabled and the first and second sensors 134, 136 detect a water temperature within the COOLING-RATE-DEPENDENT-ON zone 1004 after exiting the NO-CHANGE zone 1006 or the OFF zone 1008, the logic unit 132 may maintain the current off state of the heater 108. Alternatively, the logic unit 132 may initiate a heat cycle when the water cools at a rate exceeding a cooling rate threshold.

The cooling rate threshold may be a threshold for comparing the rate of change of the average water temperature measured by the first and second sensors 134, 136 as the water in the tank 102 cools. The cooling rate threshold may be satisfied when the first and second sensors 134, 136 detect an average rate of change that is greater than the cooling rate threshold. For example, the cooling rate threshold may be approximately 2 degrees Fahrenheit per minute. However, the cooling rate threshold may be other rates as well.

When entering the COOLING-RATE-DEPENDENT-ON zone 1004 from ON zone 1002, the water is being heated, so the cooling-rate dependent condition does not apply. When the first and second sensors 134, 136 detect a water temperature within the COOLING-RATE-DEPENDENT-ON zone 1004 after exiting the ON zone 1002, the logic unit 132 may maintain the previously initiated heat cycle. As such, the logic unit 132 may signal the gas-flow-valve actuator 138 to remain on. This signal may remain until the water temperature enters the OFF zone 1008.

As described, the temperature control algorithm may be modified to track how long a water draw lasts and adjust the UT1 differential to control the amount of temperature stacking allowed; adjust the LT1 differential based on a maximum time between water draws; modify the OFF zone boundary 1032 to have a double step down function; and disable the COOLING-RATE-DEPENDENT-ON zone 1004 based on water draw time, cycling time, and average water temperature. By modifying the temperature control algorithm in this manner, the water heater 100 may have improved efficiency with minimal impact to a user of the water heater 100.

5. Thermal Cutout

In many legacy water heaters, single-shot and/or thermal cutout units or switches provide overheat protection when one or more elements of the legacy controller fail. This overheat condition may occur when the temperature of the water exceeds a preset overheat limit that is typically built into the thermal cutout units.

The logic unit 132 (or some other fail-safe circuitry of the controller assembly 110) in combination with the first and/or second sensors 134, 136 may replace the thermal cutout units. Alternatively, this combination may be redundant to the thermal cutout units.

Figure 9:
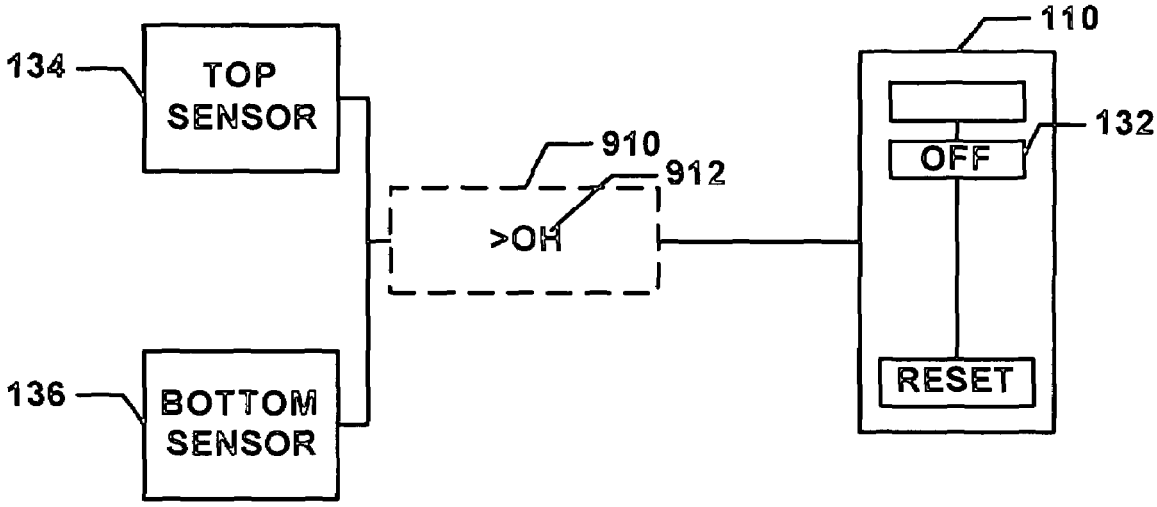
FIG. 9 is a fifth state diagram illustrating a sixth of the operational states for the controller shown in FIG. 2 in accordance with another exemplary embodiment.

FIG. 9 is a state diagram showing a thermal cutout operation of the controller assembly 110. As noted above, the logic unit 132 will (i) stop the heater from initiating or maintaining a heat cycle, and (ii) prevent the water heater from further operation until being serviced and reset. The logic unit 132 may initiate this cutout protection when a cutout condition 910 is satisfied.

The cut-out condition 910 may be satisfied when the first sensor 134 detects, measures, or otherwise determines that the water temperature at or near the top of the tank 102 is greater than a predetermined-overheat state condition 912. Alternatively, the cut-out condition 910 may be satisfied when the second sensor 136 detects, measures, or otherwise determines that the water temperature at or near the bottom of the tank 102 is greater than a predetermined-overheat state condition 912.

The predetermined-overheat state condition 912 may be approximately 5 degrees above the predetermined-maximum temperature 304. The predetermined-overheat state condition 912 may be other temperatures as well.

6. Conclusion

In view of the wide variety of embodiments to which the principles of the present invention can be applied, it should be understood that the illustrated embodiments are exemplary only, and should not be taken as limiting the scope of the present invention. For example, the method steps described may be taken in sequences other than those described, and more or fewer elements may be used in the block diagrams. Further, the claims should not be read as limited to the described order or elements unless stated to that effect. In addition, use of the term "means" in any claim is intended to invoke 35 U.S.C. §112, ¶6, and any claim without the word "means" is not so intended. Therefore, all embodiments that come within the scope and spirit of the following claims and equivalents thereto are claimed as the invention.

Preferred and alternative embodiments of the present invention have been illustrated and described. It will be understood, however, that changes and modifications may be made to the invention without deviating from its true spirit and scope, as defined by the following claims.

What is claimed is:

1. A water heater, comprising in combination:

a tank for holding water having at least one water temperature;

a heater for heating the water;

first and second sensors, the first sensor detecting a first water temperature and responsively providing a first temperature signal, the second sensor detecting a second water temperature and responsively providing a second temperature signal; and a controller having logic to regulate the heater based on a water draw time, wherein the first and second temperature signals are used to determine the water draw time and wherein the logic adjusts a first temperature differential based on the water draw time and a second differential temperature is adjusted based on the adjustment of the first temperature differential.

2. The water heater of claim 1, wherein the first temperature differential is adjusted between a default value and zero degrees Fahrenheit.

3. The water heater of claim 2, wherein the default value is substantially eight degrees Fahrenheit.

4. The water heater of claim 1, wherein the first temperature differential is reduced when the water draw time increases.

5. The water heater of claim 1, wherein the first temperature differential is adjusted to modify allowable temperature stacking in the tank.

6. The water heater of claim 1, wherein the second temperature differential is adjusted to a temperature substantially two degrees below the first temperature differential.

7. The water heater of claim 1, wherein the first temperature differential is adjusted if a maximum time between water draws is within a window of time.

8. The water heater of claim 7, wherein the window of time is substantially five to ten hours.

9. The water heater of claim 7, wherein the first temperature differential is reduced from a default value if the maximum time between water draws is within the window of time.

10. The water heater of claim 9, wherein the default value is substantially twenty degrees Fahrenheit.

11. The water heater of claim 9, wherein the first temperature differential is reduced to substantially seven degrees Fahrenheit if the maximum time between water draws is within the window of time.

12. The water heater of claim 1, wherein the logic further regulates the heater based on average water temperature and heat cycle time, wherein the first and second temperature signals are used to determine the average water temperature.

13. The water heater of claim 12, wherein the logic disables a heater-control zone based on the water draw time, the average water temperature, and the heat cycle time.

14. The water heater of claim 13, wherein the heater-control zone is a cooling-rate-dependent-on zone.

15. The water heater of claim 14, wherein the logic initiates a heat cycle in the cooling-rate-dependent-on zone when water in the tank cools at a rate exceeding a cooling rate threshold.

16. The water heater of claim 15, wherein the cooling rate threshold is substantially two degrees Fahrenheit per minute.

17. The water heater of claim 13, wherein the logic disables the heater-control zone unless the heater is off for less than a first time or greater than a second time and the average water temperature is less than a first temperature.

18. The water heater of claim 17, wherein the first time is substantially thirty minutes and the second time is substantially five hours.

19. The water heater of claim 17, wherein the first temperature is a setpoint temperature minus a second temperature.

20. The water heater of claim 19, wherein the second temperature is substantially fifteen degrees.

21. The water heater of claim 19, wherein the setpoint temperature is a user selected temperature.

22. The water heater of claim 19, wherein the setpoint temperature is substantially 135 degrees Fahrenheit.

23. The water heater of claim 12, wherein the logic controls a heater-control zone to have a double step down function.

24. The water heater of claim 23, wherein the heater-control zone is an OFF zone.

25. A water heater, comprising in combination:

a tank for holding water having at least one water temperature;

a heater for heating the water;

first and second sensors, the first sensor detecting a first water temperature and responsively providing a first temperature signal, the second sensor detecting a second water temperature and responsively providing a second temperature signal; and a controller having logic to regulate the heater, wherein the logic adjusts a first temperature differential based on a water draw time and a second temperature differential based on the adjustment of the first temperature differential, wherein the logic disables a first heater-control zone based on an average water temperature, the water draw time, and a heat cycle time, and wherein the logic controls a second heater-control zone to have a double step down function.

* * * * *